US005226641A

United States Patent [19]

Schieleit

[11] Patent Number: 5,226,641

[45] Date of Patent: Jul. 13, 1993

[54] STORAGE AND STACKING DEVICE FOR FLAT OBJECTS

[75] Inventor: Jurgen Schieleit, Dortmund, Fed. Rep. of Germany

[73] Assignee: Fraunhofer-Gesellschaft Zur Forderung Der Angewandten Forschung e.V., Munich, Fed. Rep. of Germany

[21] Appl. No.: 728,598

[22] Filed: Jul. 11, 1991

[30] Foreign Application Priority Data

Jul. 13, 1990 [DE] Fed. Rep. of Germany ..... 4022349

[51] Int. Cl.[5] ..... B65H 29/00

[52] U.S. Cl. ..... 271/187; 271/215; 271/198

[58] Field of Search ..... 271/315, 187, 207, 214, 271/215, 217, 218, 83; 221/78-80

[56] References Cited

U.S. PATENT DOCUMENTS 3,162,438 12/1964 Perry ..... 271/214
3,355,169 11/1967 Seyl ..... 271/187
3,409,290 11/1968 Bergland ..... 271/187
4,228,997 10/1980 Schoonmaker et al. ..... 271/315
4,275,874 6/1981 DiBlasio ..... 271/187

FOREIGN PATENT DOCUMENTS 57-48557 10/1982 Japan .

*Primary Examiner*—H. Grant Skaggs
*Attorney, Agent, or Firm*—Weingarten, Schurgin, Gagnebin & Hayes

[57] ABSTRACT

A storage and stacking device for flat objects such as mail or newspapers includes boxes for temporarily storing, transporting, and stacking the objects. Boxes are arranged on the stacking device at an angle of less than 90° and coupled to a connecting element. The device has a fixed stack support associated with the boxes, and a movable stack support which is movable relative to the fixed stack support. The boxes and the fixed stack support are movable relative to one another. The boxes and the fixed stack support are formed by comb-like elements. The box comb-like elements comb through the fixed stack support comb-like elements during the relative motion of the box with respect to the fixed stack support. The box comb-like elements, the movable stack support and the fixed stack support are always in a positive contact with the stack of the objects.

5 Claims, 3 Drawing Sheets

STORAGE AND STACKING DEVICE FOR FLAT OBJECTS

FIELD OF THE INVENTION

The invention relates to a storage and stacking device or flat objects such as mail or newspapers.

BACKGROUND OF THE INVENTION

Storage and stacking devices used to store and stack various parts, for example letters, newspapers, magazines, folded sheets, cards, film bags and like, are known. They are used primarily in the distribution and sorting areas of the post office and similar operations. Known letter sorting and distributing systems are very limited in the range of shipments which they can process. A majority of the shipments encountered today in the post office are classified as "not machine-handleable" because no distribution systems exist for these types of shipments. Problems occur in picking, sorting, transporting, and stacking different shipments.

JP-PS 57-48557 teaches a device for stacking and storing postal shipments. It consists of a circular endless belt on which individual boxes are arranged in which letters or the like are placed by means of a suitable feed device. These pieces are placed on a stack conveyor located beneath the feed device. A stack support is located on this stack carrier. The pieces of mail are placed in the boxes by the feed device. To keep them from tipping over and guide them correctly, guidance of the letter is necessary; this is provided by a feed device since otherwise there is a danger that the letter will either fall out of the box or onto the belt or get jammed between the belt and the box or fall backward.

It is also necessary to provide a roller which ensures that the corresponding travel of the belt will keep the letters or pieces of mail that are added in a vertical position. It is only possible with this vertical position for the pieces of mail to be added to the forming stack to be vertical at the outset. The letters are added to the stack in such a way that the box crosses through the stack carrier.

However, to keep it from cutting into the already stacked pieces of mail, the stack support must move backward so that the entire stack can be moved by the moving box and by the incoming mail so that the box has sufficient room to pass through the stack carrier. This causes the stack which is already on the stack carrier to fall back or makes it sufficiently unstable that the individual pieces of mail are displaced with respect to one another and against the support as well as against the other incoming shipments. This displacement can take place either laterally, forward or backward.

Another disadvantage is that smaller pieces of mail can drop through an opening that matches the size of the box. The device disclosed in JP-PS 57-48557 is consequently only usable on a limited basis.

SUMMARY OF THE INVENTION

The present invention provides a storage and stacking device wherein it is possible to form an orderly stack out of flat objects such as newspapers and pieces of mail that differ both in size and in dimensions, with the stack remaining stable even during the stacking process, thus eliminating falling over, slipping or twisting of individual pieces.

The present invention ensures that the flat objects located in boxes during the relative movement between a stack conveyor and the boxes are combed out of the boxes and transferred positively to a stack of objects. In the devices according to the present invention, this is not merely a simple spreader for flat objects such as pieces of mail, but a device which guides the pieces of mail at every point in time during the stacking process and in which formation of the stack can be monitored at every point in the stacking process.

The pieces of mail to be added to the stack are guided positively according to the invention and supported on three sides at all times during the stacking process; at the front by boxes, on the bottom by a fixed stack support, and at the back by a movable support which is always in contact positively with the stack.

The comb-like design of the boxes and fixed stack support provides another advantage of the device according to the invention, namely that none of the pieces of mail or flat objects can remain stuck in the box, regardless of the size of the piece of mail that is added, since these pieces of mail are "combed out". Thus, the device according to the invention is suitable for various sizes of mail pieces.

The formation of an orderly stack is possible with practically all types of mail pieces. In addition it is also especially advantageous that, as a result of the design according to the invention, the parts are forcibly dumped out, in other words no pieces can remain stuck in the box. The fact that the stack is always supported on three sides does not allow any parts to fall out and even parts of different sizes can be stacked into one stack. Furthermore it is advantageous that during removal of the stack from the stack support the station need not be blocked but the storage process can be continued, at least until the boxes between the addition and subtraction points are full. By using additional elements, storage can continue until all the boxes are full.

According to another advantageous embodiment of the invention the parts are removed from the boxes to the stack support in such fashion that they initially touch the fixed stack support with their undersides. As a result, even parts that are lying crookedly in the box will be aligned. The fixed stack support constitutes a reference plane for aligning the object.

For especially difficult storage processes or for storage and stacking processes with a high throughout, it can be especially advantageous to make the connecting element in the form of a conveyor. The combs of the boxes are mounted on the latter.

BRIEF DESCRIPTION OF THE DRAWINGS

These, and other features and advantages of the present invention will be better understood by reading the following detailed description taken together with the drawings, wherein.

DETAILED DESCRIPTION OF THE INVENTION

Figure 1:
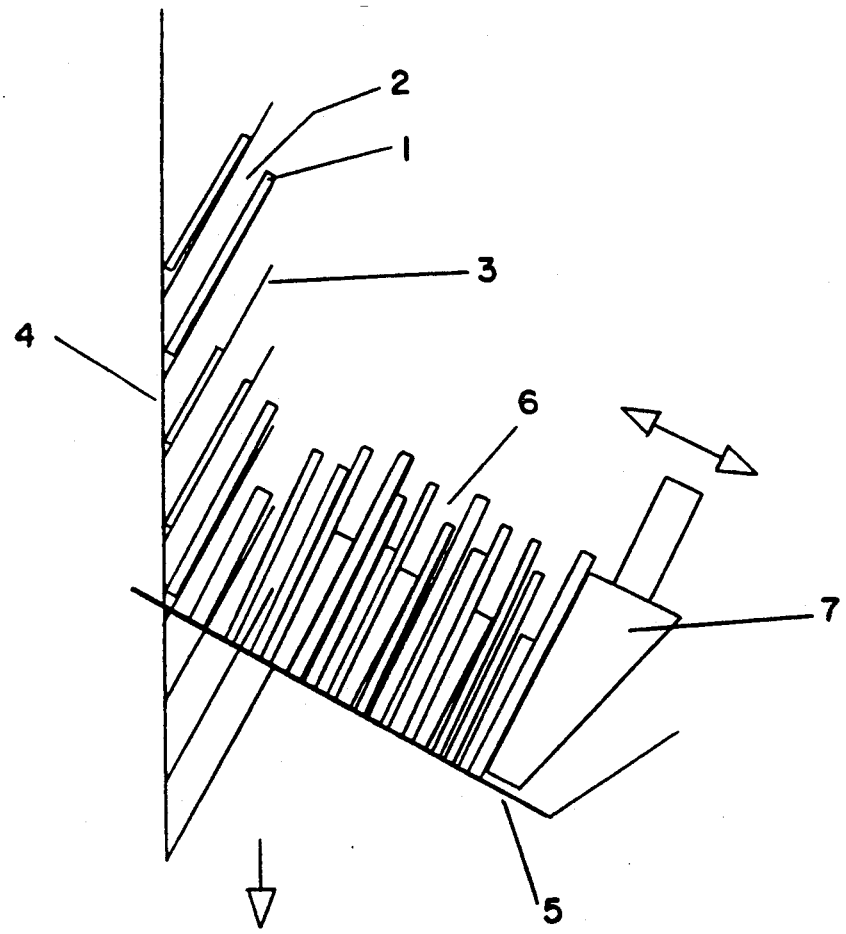
FIG. 1 is a schematic diagram of the storage and stacking device according to the invention.
Figure 2:
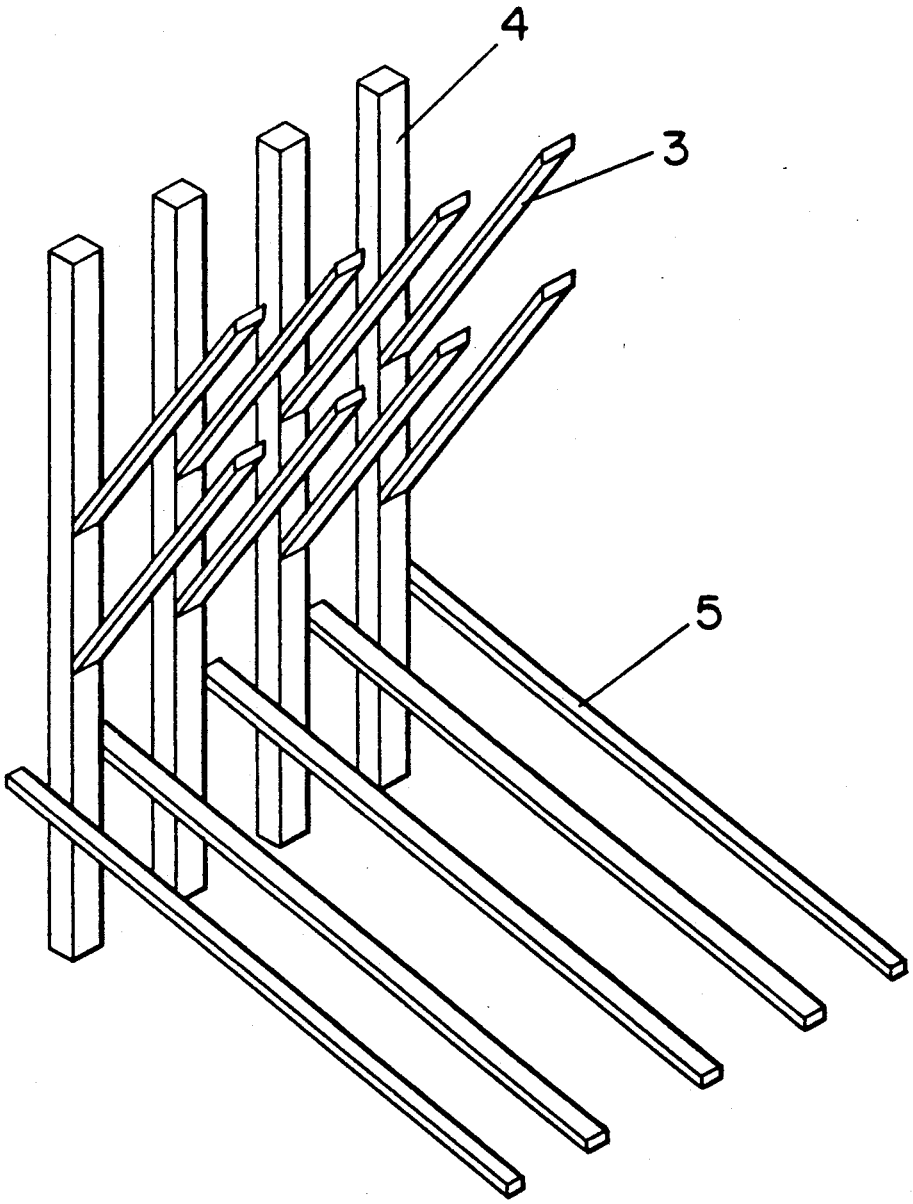
FIG. 2 is a three-dimensional view of the penetration of the box combs with the stack support combs.

As FIGS. 1 and 2 show, parts 1 to be stacked are located in temporary storage and transporting boxes 2 which are formed by comb-like elements 3 and a connecting element 4. The boxes can be filled by known techniques, such as belt conveyors for example. The following functional principle applies: for stacking, boxes 2 and at least one fixed stack support 5, likewise formed by comb-like elements, are moved relative to one another. Boxes 2 and stack support 5 are arranged so that the comb-like elements of boxes 2 and comb-like elements of fixed stack support 5 are interspersed and mesh with one another. In this process, parts 1 are combed out of boxes 2 and one part after the other is conveyed to stack 6 which is forming. Stack 6 is supported on three sides at all times by fixed stack support 5 at the bottom of the stack, movable stack support 7 at the back of the stack, and comb-like elements 3 at the front of the stack. The process is independent of the nature, size, and weight of parts 1 in boxes 2.

Figure 3:
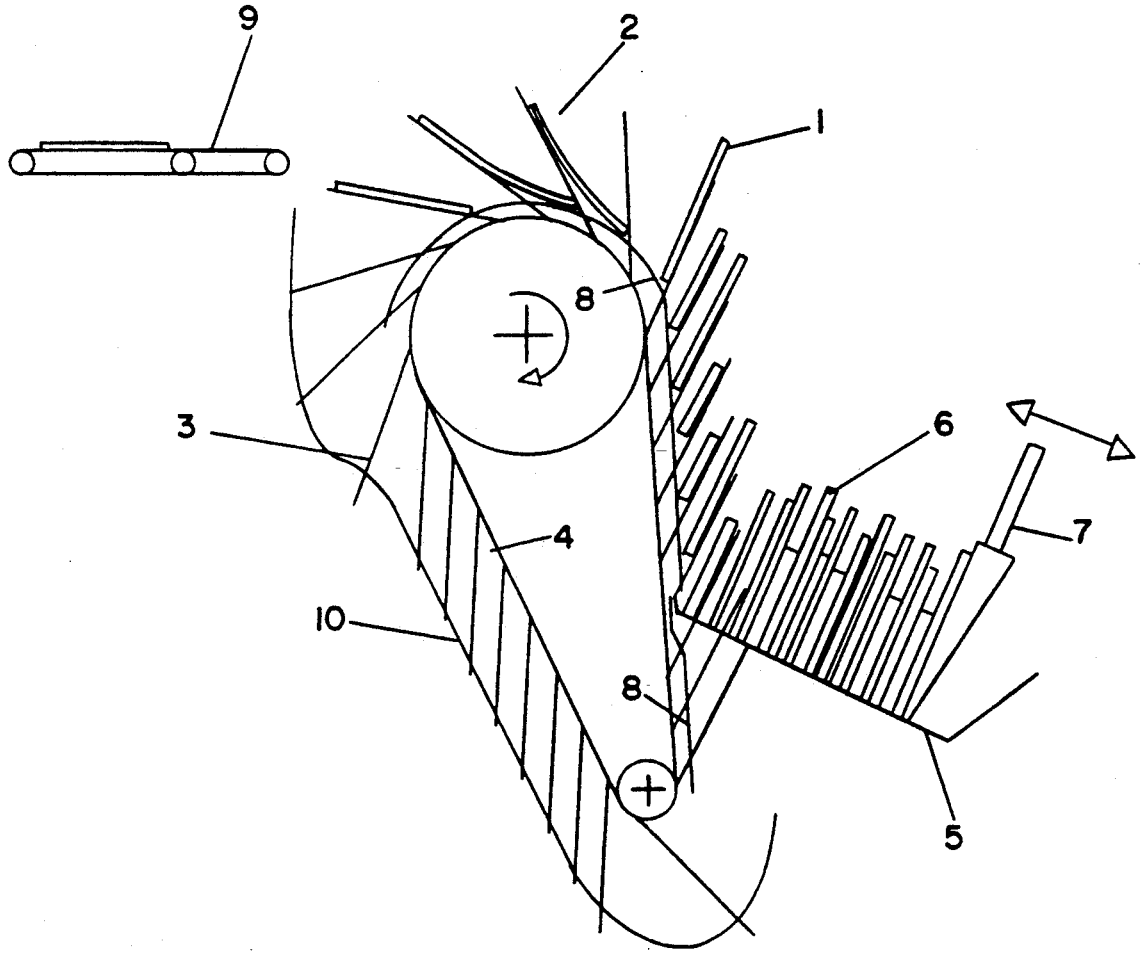
FIG. 3 is a schematic diagram of another embodiment of the stacking and storage device of the present invention.

According to the embodiment in FIG. 3, the following functional principle applies to the storage and stacking device. Parts 1 are conveyed by one or more conveyors 9 into boxes 2 of the storage and stacking device of the present invention. The storage and stacking device in this figure is shown as a recirculating conveyor belt. Connecting element 4 is designed as a chain on whose links comb-like elements 3 are mounted. Guide rail 8 in this embodiment prevents parts 1 from sliding into chain 4.

The circulating motion of chain 4 combs fixed stack support 5 through boxes 2. If stack support 5 is full, it can be replaced while at the same time additional pieces are added to boxes 2 by conveyor 9. In this embodiment, fixed stack support 5 can be designed as a holder. The storage action of the device shown is determined by the number of boxes 2 which are located between conveyor 9 and stack support 5, here designed as a container. By mounting cover strips 10 that prevent parts 1 from slipping out during overhead conveyance, parts can be given intermediate storage in all boxes 2 of the storage and stacking device.

Modifications and substitutions by one of ordinary skill in the art are considered to be within the scope of the present invention which is not to be limited except by the claims which follow.

I claim:

1. A storage and stacking device for forming a stack of objects conveyed toward a rotating drum said storage and stacking device comprising:

a movable, flexible connecting and conveying element adapted to be disposed about said drum;

a plurality of boxes for temporarily storing and transporting at least one of said objects, each of said plurality of boxes formed by a plurality of comb-like elements, each of said first plurality of comb-like elements coupled to the movable, flexible connecting and conveying element at an angle of less than 90° wherein during rotation of said drum, said objects are first disposed on a first surface of a first one of said first plurality of comb-like elements and are subsequently disposed on a first surface of a second adjacent one of said first plurality of comb-like elements as said first and second comb-like elements move over a portion of said drum;

at least one fixed stack support disposed in proximity to said connecting element and said plurality of boxes, said fixed stack support formed by a plurality of comb-like elements, said plurality of boxes movable with said connecting element relative to said at least one fixed stack support, wherein during movement of said plurality of boxes relative to said at least one fixed stacked support at least one of said comb-like elements of each of said plurality of boxes is interspersed between and meshing with said comb-like elements of said at least one fixed stack support and wherein said fixed stack support continuously supports a first side of said stack of objects;

at least one movable stack support disposed in proximity to said at least one fixed stack support wherein said moveable stack support continuously supports a second different side of said stack of objects; and wherein at least one of said comb-like elements forming said boxes is continuously in positive contact with a side of said stack of objects opposite said second side of said stack of objects.

2. The storage and stacking device of claim 1 wherein said stack of objects is disposed on said fixed stack support and wherein said side of the stack of objects opposite said second side of said stack corresponds to a front end of said stack and said second side of said stack corresponds to a back end of said stack.

3. The storage and stacking device of claim 2 wherein said fixed stack support provides a fixed reference plane for aligning said stack of objects.

4. The storage and stacking device of claim 1 wherein said fixed stack support provides a fixed reference plane for aligning said stack of objects.

5. The storage and stacking device of claim 1 wherein said connecting element comprises a continuous conveyor.

* * * * *

UNITED STATES PATENT AND TRADEMARK OFFICE

CERTIFICATE OF CORRECTION

PATENT NO. : 5,226,641

DATED : July 13, 1993

INVENTOR(S) : Jurgen Schieleit

It is certified that error appears in the above-identified patent and that said Letters Patent is hereby corrected as shown below:

Column 2, line 46, "throughout" should read —throughput—.

Signed and Sealed this

Second Day of August, 1994

Attest:

Attesting Officer

BRUCE LEHMAN

Commissioner of Patents and Trademarks